US006049276A

United States Patent [19]

Agozzino

[11] Patent Number: 6,049,276

[45] Date of Patent: Apr. 11, 2000

[54] BURGLAR CHAIN ALARM

[76] Inventor: Andrew Agozzino, 7202 NW. 89th Ave., Tamarac, Fla. 33321

[21] Appl. No.: 09/208,179

[22] Filed: Dec. 9, 1998

Related U.S. Application Data

[63] Continuation-in-part of application No. 09/032,823, Mar. 2, 1998, abandoned.

[51] Int. Cl.[7] ..... G08B 13/08

[52] U.S. Cl. ..... 340/545.1; 200/61.62; 340/548

[58] Field of Search ..... 340/545.1, 548; 200/61.62, 61.71–61.77

[56] References Cited

U.S. PATENT DOCUMENTS

| | | | |
|---|---|---|---|
| 2,825,777 | 3/1958 | Gould | 200/61.72 |
| 3,406,386 | 10/1968 | Hawkins | 340/548 X |
| 3,714,644 | 1/1973 | Hellstrom | 340/542 X |
| 4,124,847 | 11/1978 | Cashman | 340/545 |
| 4,191,947 | 3/1980 | Bouchard et al. | 340/548 X |
| 4,205,305 | 5/1980 | Nakada | 340/548 |
| 4,206,452 | 6/1980 | Blasucci | 340/548 |
| 4,233,595 | 11/1980 | Landkammer | 340/548 X |

*Primary Examiner*—Thomas Mullen
*Attorney, Agent, or Firm*—Oltman, Flynn & Kubler

[57] ABSTRACT

An alarm and latch apparatus for a closure panel mounted within an opening perimeter of a building opening includes a closure panel link member having a link member first end mounted to the closure panel and a link member second end including a slot engaging slide; and a latch box having a slide slot with a slot end opening for receiving a portion of the slide, the latch box being mounted to the opening perimeter and containing an alarm circuit including a mechanism for alarm activation upon movement of the slide along the slide slot.

19 Claims, 2 Drawing Sheets

BURGLAR CHAIN ALARM

FILING HISTORY

This application is a continuation-in-part of application Ser. No. 09/032,823, filed on Mar. 2, 1998 now abandoned.

BACKGROUND OF THE INVENTION

1. Field of the Invention

The present invention relates generally to the field of security devices for buildings, and particularly for homes. More specifically the present invention relates to a door or window lock including a conventional slide chain mounted to the door or sliding window frame which engages a slot in a latch box mounted to the door or window perimeter frame. The latching box contains an alarm circuit which is activated by movement of the chain along the slot.

2. Description of the Prior Art

There have long been locks and alarm systems for preventing unauthorized entry into buildings. These have in some instances been integrated together so that breaking or lateral movement of a bolt triggers the alarm. A problem with these latter type of prior devices has been that they generally do not operate in concert with the conventional bolt assembly many people have on doors, which are conveniently operated with house keys. In these instances the alarm must be set, neutralized and deactivated in a separate operation from simply locking and unlocking the door, discouraging hurried people from using their alarm systems all of the time. Alternatively, in the few instances in which a generally conventional bolt assembly is used, deactivation of a triggered alarm can be complicated and difficult.

One such prior device is that of Gould, U.S. Pat. No. 2,825,777, issued on Mar. 4, 1958. Gould discloses a burglar alarm including a battery-powered electric alarm mounted on a door or window which is connected by a two-wire cable to a detector switch unit mounted on a door or window frame. The detector switch includes a toggle-pivoted and preferably dielectric detector element engaged with a window sash. The detector switch is a two-arm spring switch, with one arm being longer than the other and having the detector element pivotally mounted on its free end. The two-arms of the switch in contact until the detector element is engaged by the sash and moved to a horizontal position so that its mounting arm is sprung away from the other switch arm. A problem with Gould is that the two-wire cable interconnecting the wall and door or window mounted alarm portions offers no real resistance to opening the door or window, and such opening would rip the wires out of the switch and damage the unit.

Cashman, U.S. Pat. No. 4,124,847, issued on Nov. 7, 1978, reveals a door alarm system. Cashman includes a door switch mounted on the hinge side of a door which operates through the movement of a pivoting conductive arm within the switch, the arm free end being connected to the door frame or wall by a chain. The arm is spring biased to keep the circuit closed, and the chain overcomes the biasing when engaged while the door is closed. Opening the door while the chain engages the switch removes tension in the chain and creates chain slack, so that the arm pivots with the biasing of the spring to close the circuit and activate the alarm. A problem with Cashman is that the chain does not inhibit opening of the door and the latching or locking of the door must be accomplished as a separate step from setting the alarm.

Nakada, U.S. Pat. No. 4,205,305, issued on May 27, 1980, teaches a burglar alarm. Nakada includes a housing which contains a bell assembly and a battery compartment connected in series with a switch assembly. The switch assembly has a linearly movable element which can be displaced a predetermined threshold distance by a chain extending to a magnet temporarily joined to a metal bracket attached to a movable surface. The switch assembly contains a pivoted contact which moves against a fixed contact when the linearly movable element is displaced the predetermined distance. The contact remains there regardless of the subsequent position of the linearly moveable element until a button operationally connected to the switch assembly is moved to the off position. A problem with Nakada is that it does not include or combine with a bolt or lock. When significant force is applied to open the door or window, the magnetically retained holder 30 simply pulls free of metal bracket 34. Nakada offers only the attractive force of a small magnet against the brute strength of an intruder.

Blasucci, U.S. Pat. No. 4,206,452, issued on Jan. 3, 1980, discloses a tension cord burglar alarm. Blasucci includes web of tensioned cord secured to a window with suction cup fasteners. The web contains a switch activated by a change in cord tension, as might result from opening the window or from breaking through the window and pressing against the cords. A problem with Blasucci is that the suction cup fasteners could slip slightly relative to each other, change the cord tension and cause a false alarm. Another problem with Blasucci is that the cord offers no significant resistance to unauthorized opening of a window or door as a bolt or latch would.

It is thus an object of the present invention to provide a door and window securing combined alarm and latch apparatus which simultaneously locks the door or window and sets an alarm against unauthorized entry.

It is another object of the present invention to provide such an apparatus which permits partial opening of the door or window before the chain engages to stop further movement, sounding the alarm during this interval, so that the alarm sounds prior to intruder entry, giving building occupants and police greater response time.

It is finally an object of the present invention to provide such an apparatus which is strong, simple, reliable and relatively inexpensive to manufacture.

SUMMARY OF THE INVENTION

The present invention accomplishes the above-stated objectives, as well as others, as may be determined by a fair reading and interpretation of the entire specification.

An alarm and latch apparatus is provided for a closure panel mounted within an opening perimeter of a building opening, including a closure panel link member having a link member first end mounted to the closure panel and a link member second end including a slot engaging slide; and a latch box having a slide slot with a slot end opening for receiving a portion of the slide, the latch box being mounted to the opening perimeter and containing an alarm circuit including a mechanism for alarm activation upon movement of the slide along the slide slot.

The latch box preferably includes a housing including a building wall engaging fastening panel and an opposing and outwardly directed slot panel including the slide slot, and a perimeter panel interconnecting the wall fastening panel and the slot panel. The link member first end preferably is secured to the closure panel with an eyelet anchor fastened to the closure panel. The housing preferably contains a battery mount connected to the housing having a spring clip and battery terminal fittings and containing a battery, a sound generator mounted to the housing, a contact mount protruding from the fastening panel toward the slot panel including an electrical mount contact, alarm circuit wiring extending from at least one of the battery terminal fittings to the sound generator and to the contact mount, a pivot arm having an arm first end fitted with an electrical arm contact connected to the alarm circuit wiring and an arm second end, a fulcrum mount protruding toward the slot panel from the fastening panel and hingedly secured with a fulcrum pin to the middle of the pivot arm, where the pivot arm extends substantially parallel and adjacent to the slide slot, so that upon insertion of the slide into the slide slot receiving opening, the slide abuts the arm second end, and movement of the slide along the slot beyond the fulcrum pin causes the slide to ride along the pivot arm first end, causing the pivot arm first end to pivot toward the fastening panel until the mount contact and the arm contact meet and close the alarm circuit and thereby activate the sound generator.

The latch box slot panel preferably includes at least one hole for releasing sound waves generated by the sound generator. The arm second end includes an arm arch progressing toward the slot panel as the second end progresses away from the fulcrum pin. The apparatus preferably additionally includes an arm biasing spring extending between the latch housing and the pivot arm, biasing the arm second end toward the slot panel, so that the mount contact and the arm contact are separated from each other.

The housing alternatively contains a battery mount connected to the housing having a spring clip and battery terminal fittings and containing a battery, a sound generator mounted to the housing, alarm circuit wiring extending from at least one of the battery terminal fittings to the sound generator, a leaf spring having a spring first end and a spring second end, the spring first end being mounted within the latch box so that the spring second end extends in cantilever fashion in spaced relationship to and along the slide slot and in spaced relationship to one of the battery terminal fittings, the leaf spring being electrically conductive and electrically connected to the alarm circuit wiring, so that upon insertion of the slide into the slide slot receiving opening, the slide abuts the leaf spring, and movement of the slide along the slide slot causes the slide to ride along the leaf spring toward the spring second end, causing the leaf spring second end to pivot toward the fastening panel until the leaf spring second end and the battery terminal fitting meet and close the alarm circuit, thereby activating the sound generator. The link member may be either a chain or a solid stem connected to a line and pulley.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
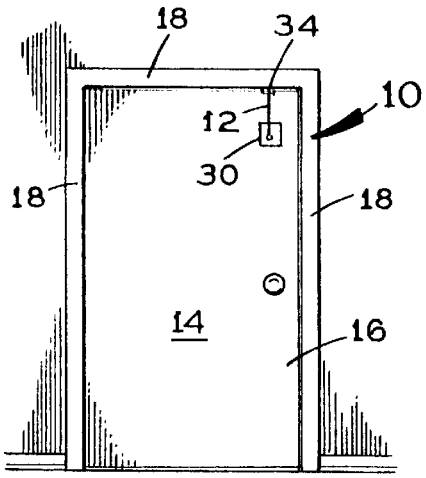
FIG. 1 is a plan view of a door from inside a building, showing the inventive alarm and chain apparatus installed.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
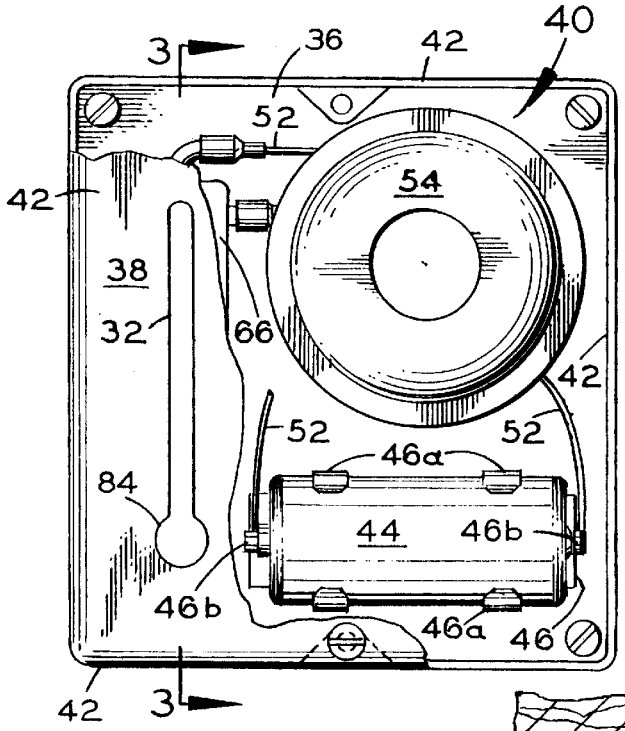
FIG. 2 is a cross-sectional close-up view of the latch box housing showing the alarm circuit and its elements, and part of the slot panel containing the slot.
Figure 3:
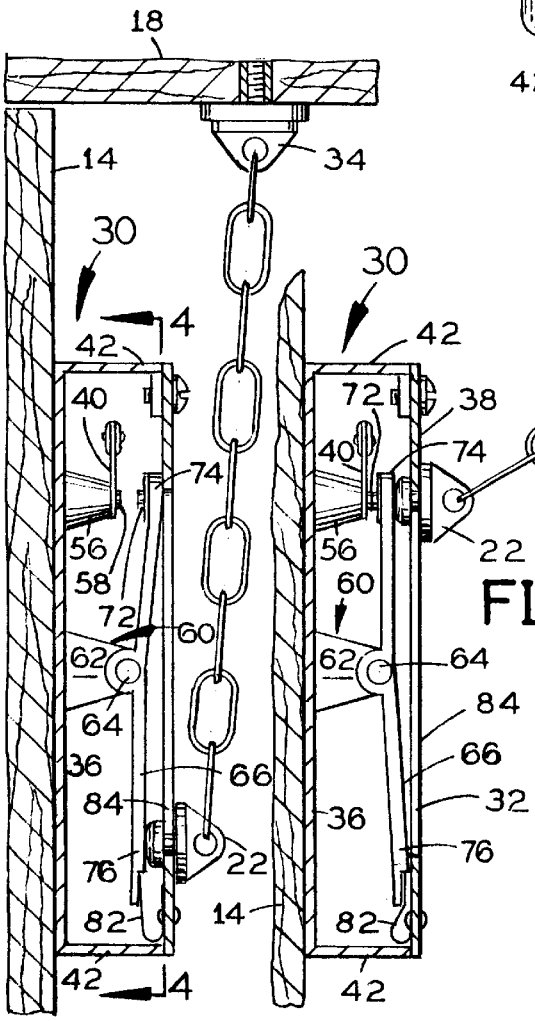
FIG. 3 is a cross-sectional side view of the latch box housing taking along the slot showing the pivot arm, arm spring, the arm mount structure, and the contact mount, and the slide in the slot abutting the pivot arm second end, with the contacts separated.
Figure 5:
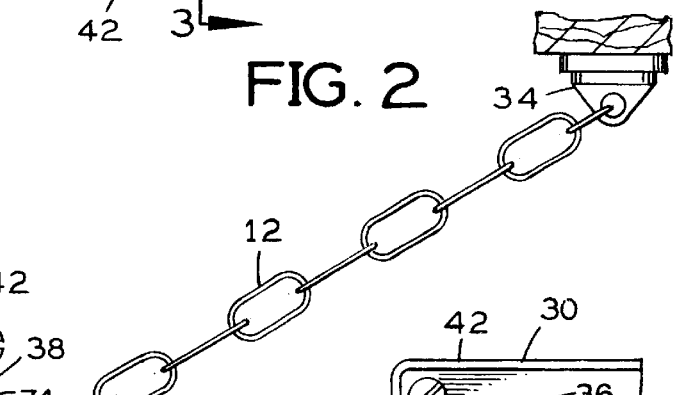
FIG. 5 is a view as in FIG. 3, showing the slide at the arm first end, pivoting the arm to bring the contacts together.
Figure 4:
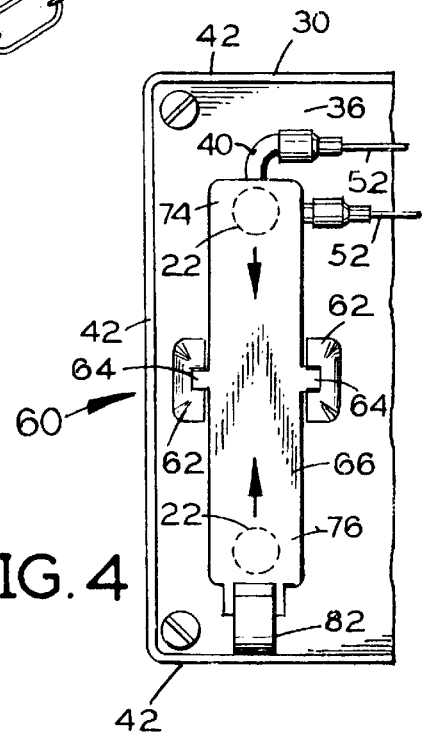
FIG. 4 is a partial cross-sectional front view of the latch box housing showing the pivot arm and the positions at both extreme longitudinal ends of the slot of the slide in broken lines on top of the pivot arm.
Figure 6:
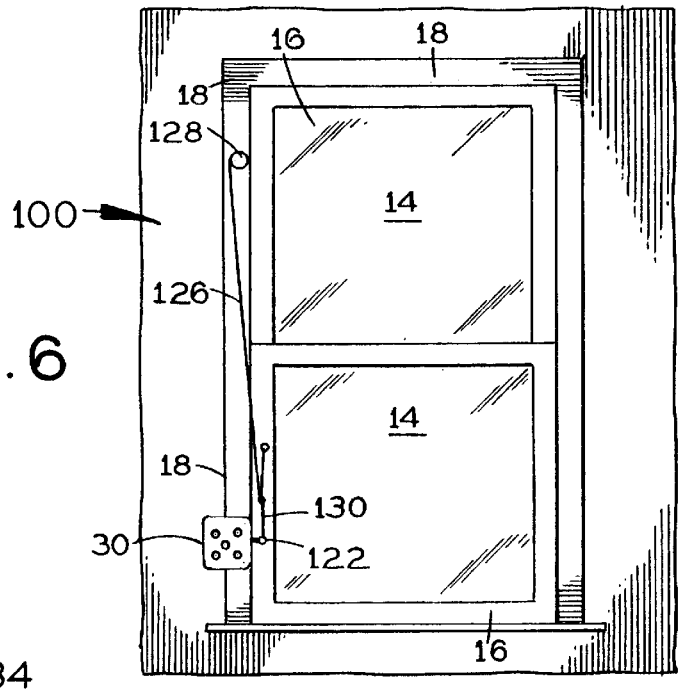
FIG. 6 is a plan view of a window from the inside of the building showing the apparatus of the second embodiment installed.
Figure 7:
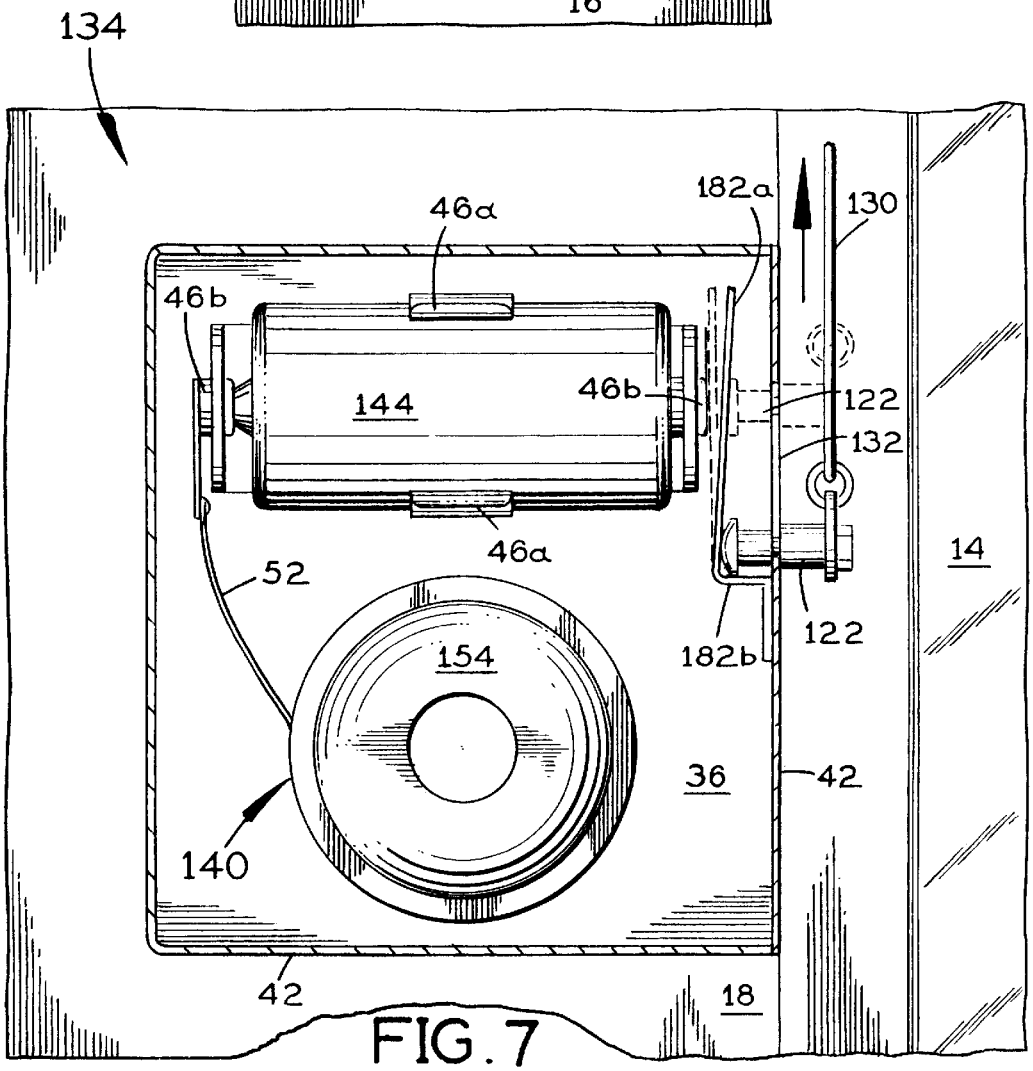
FIG. 7 is a cross-sectional front view of the latch box housing taken along the slot, showing the alarm circuit and circuit elements, including the leaf spring and slide at the slot entry point with the leaf spring biased away from the battery terminal fitting. The slide is shown in a second position in broken lines pressing the leaf spring into contact with the battery terminal fitting, closing the alarm circuit to sound the alarm.

Referring to FIGS. 1–7, an alarm and latch apparatus 10 is disclosed, including link member in the form of a conventional slide chain 12 mounted to the closure panel 14 of a building opening 16 such as a door or sliding window, which engages a chain slot 32 in a latch box 30 mounted to the building opening perimeter frame 18. Latch box 30 contains an alarm circuit 40 which is activated by movement of the chain 12 along slot 32.

Chain 12 has an anchored end secured to an eyelet anchor 34 fastened to the opening side of a closure panel 14 such as the pivoting side of a door or the lower end of a sliding window frame, and has a free end fitted with a slot engaging slide 22. Latch box 30 includes a flattened cube-shaped metal housing having a building wall engaging fastening panel 36 and an opposing and outwardly directed slot panel 38 including chain slot 32, and perimeter panels 42 interconnecting wall engaging fastening panel 36 and slot panel 38. Housing 34 contains a power source, preferably in the form of a dry cell battery 44 mounted to wall engaging fastening panel 36 with a battery mount 46 having spring clips 46*a* and battery terminal fittings 46*b*. Alarm circuit wiring 52 extends from battery 44 to a buzzer sound generator 54, also mounted to wall engaging fastening panel 36 and a contact mount 56 fitted with a mount contact 58 and protruding outwardly from fastening panel 36 and connected by the wiring 52 to sound generator 54. A fulcrum mounted pivot 60 is provided including a fulcrum mount 62 protruding outwardly from fastening panel 36 and hingedly secured with a fulcrum pin 64 to the middle of a pivot arm 66, the pivot arm 66 extending parallel and adjacent to chain slot 32. Pivot arm 66 has an arm contact 72 at an arm first end 74 and a slight outward arch at an arm second end 76. Arm contact 72 is connected to alarm circuit wiring 52. Arm second end 76 is held pivoted inwardly by an arm spring 82 so that the mount and arm contacts are kept separated from each other.

Chain slot 32 has a circular slot receiving opening 84 at its remote end from the closure panel 14 through which the slide 22 is inserted. Upon insertion of slide 22 into chain slot receiving opening 84, the slide 22 abuts arm second end 76, and rides along pivot arm 66 as it is slid along chain slot 32 to a point approaching fulcrum pin 64. Then, when an intruder pushes the closure panel 14 partly open, the chain 12 reaches the end of slot 32 and prevents further opening and the movement of slide 22 along slot 32 and onto the arm first end 74 pivots arm first end 74 downwardly against the biasing of arm spring 82 until the mount and arm contacts 58 and 72, respectively, meet and begin conducting electricity, activating the sound generator 54 producing an alarm sound. Sound generator 54 sounds until slide 22 is slid back along pivot arm 66 onto arm second end 76 by the user, and the contacts 58 and 72 are thereby separated, breaking the alarm circuit 40, deactivating sound generator 54. Housing slot panel 34 preferably has holes to release sound waves emitted by sound generator 54.

Second Preferred Embodiment

A second embodiment, apparatus 100, is provided much like the first except that pivot arm 66 is replaced with a cantilever-L-shaped leaf spring 182 which is positioned adjacent to one of the battery 144 terminals and is resiliently biased away from the terminal. See FIGS. 6 and 7. The chain slot 132 for this embodiment is preferably provided in one of the perimeter panels 142 of housing 134 and extends parallel to and directly over the leaf spring 182. When the slide 122 is inserted into slot 132, it abuts the anchored end 182*b* of leaf spring 182. Opening the closure panel 14 moves the slide 122 along slot 132 so that slide 122 rides along leaf spring 182, gradually pivoting the spring 182 free end 182*a* into contact with the adjacent battery 144 terminal, completing the alarm circuit 140 and activating the sound generator 154. A chain 12 as described for the first embodiment may be used, and alternatively the link member may be pulley line 126 and pulley 128 connected to the slide 122 by a solid metal stem 130 having looped ends. The line 126 is connected to two spaced apart points of the closure panel 14, and the pulley 128 is rotatably mounted on the perimeter of the building opening 16, adjacent the closure panel 14. The line 126 rides over the pulley 128, and moves when the closure panel 14 is opened or closed, the opening causing tension in the solid stem 130, moving the engaged slide 122 along slot 132 to sound the alarm.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An alarm and latch apparatus for a closure panel mounted within an opening perimeter of a building opening, comprising:

a closure panel link member having a link member first end mounted to said closure panel and a link member second end including a slot engaging slide;

and a latch box mounted to said opening perimeter and having a latch box outer wall, said latch box outer wall having a slide slot with a slot end opening for receiving a portion of said slide such that said slide protrudes simultaneously both inside and outside said latch box and is removable from said slide slot through said slot end opening to permit said slide and said closure panel link member to separate from said latch box thereby freeing said closure panel to move relative to the opening perimeter to open the building opening, said latch box containing an alarm circuit including means for alarm activation upon movement of said slide along said slide slot.

2. The apparatus of claim 1, wherein said latch box comprises a housing including a building wall engaging fastening panel and said outer wall forming an opposing and outwardly directed slot panel including said slide slot, and a perimeter panel interconnecting said wall fastening panel and said slot panel.

3. The apparatus of claim 2, wherein said housing contains:

a battery mount connected to said housing having a spring clip and battery terminal fittings and containing a battery, a sound generator mounted to said housing, a contact mount protruding from said fastening panel toward said slot panel including an electrical mount contact, alarm circuit wiring extending from at least one said battery terminal fitting to said sound generator and to said contact mount, a pivot arm having an arm first end fitted with an electrical arm contact connected to said alarm circuit wiring and an arm second end, a fulcrum mount protruding toward said slot panel from said fastening panel and hingedly secured with a fulcrum pin to the middle of said pivot arm, wherein said pivot arm extends substantially parallel and adjacent to said slide slot, such that upon insertion of said slide into said slide slot receiving opening, said slide abuts said arm second end, and movement of said slide along said slot beyond said fulcrum pin causes said slide to ride along said pivot arm first end, causing said pivot arm first end to pivot toward said fastening panel until said mount contact and said arm contact meet and close said alarm circuit and thereby activate said sound generator.

4. The apparatus of claim 3, wherein said arm second end comprises an arm arch progressing toward said slot panel as said second end progresses away from said fulcrum pin.

5. The apparatus of claim 3, additionally comprising an arm biasing spring extending between said latch housing and said pivot arm, biasing said arm second end toward said slot panel, such that said mount contact and said arm contact are separated from each other.

6. The apparatus of claim 2, wherein said latch box slot panel comprises at least one hole for releasing sound waves generated by said sound generator.

7. The apparatus of claim 2, wherein said housing contains:

a battery mount connected to said housing having a spring clip and battery terminal fittings and containing a battery, a sound generator mounted to said housing, alarm circuit wiring extending from at least one said battery terminal fitting to said sound generator, a leaf spring having a spring first end and a spring second end, said spring first end being mounted within said latch box such that said spring second end extends in cantilever fashion in spaced relationship to and along said slide slot and in spaced relationship to one said battery terminal fitting, said leaf spring being electrically conductive and electrically connected to said alarm circuit wiring, such that upon insertion of said slide into said slide slot receiving opening, said slide abuts said leaf spring, and movement of said slide along said slide slot causes said slide to ride along said leaf spring toward said spring second end, causing said leaf spring second end to pivot toward said fastening panel until said leaf spring second end and said battery terminal fitting meet and close said alarm circuit, thereby activating said sound generator.

8. The apparatus of claim 1, wherein said link member first end is secured to said closure panel with an eyelet anchor fastened to said closure panel.

9. The apparatus of claim 1, wherein said link member is a chain.

10. The apparatus of claim 1, wherein said link member is a solid stem connected to a line and pulley.

11. An alarm and latch apparatus for a closure panel mounted within an opening perimeter of a building opening, comprising:

a closure panel link member having a link member first end mounted to said closure panel and a link member second end including a slot engaging slide;

and a latch box having a slide slot with a slot end opening for receiving a portion of said slide, said latch box being mounted to said opening perimeter and containing an alarm circuit including means for alarm activation upon movement of said slide along said slide slot, wherein said latch box comprises a housing including a building wall engaging fastening panel and an opposing and outwardly directed slot panel including said slide slot, and a perimeter panel interconnecting said wall fastening panel and said slot panel.

12. The apparatus of claim 11, wherein said link member first end is secured to said closure panel with an eyelet anchor fastened to said closure panel.

13. The apparatus of claim 11, wherein said housing contains:

a battery mount connected to said housing having a spring clip and battery terminal fittings and containing a battery, a sound generator mounted to said housing, a contact mount protruding from said fastening panel toward said slot panel including an electrical mount contact, alarm circuit wiring extending from at least one said battery terminal fitting to said sound generator and to said contact mount, a pivot arm having an arm first end fitted with an electrical arm contact connected to said alarm circuit wiring and an arm second end, a fulcrum mount protruding toward said slot panel from said fastening panel and hingedly secured with a fulcrum pin to the middle of said pivot arm, wherein said pivot arm extends substantially parallel and adjacent to said slide slot, such that upon insertion of said slide into said slide slot receiving opening, said slide abuts said arm second end, and movement of said slide along said slot beyond said fulcrum pin causes said slide to ride along said pivot arm first end, causing said pivot arm first end to pivot toward said fastening panel until said mount contact and said arm contact meet and close said alarm circuit and thereby activate said sound generator.

14. The apparatus of claim 13, wherein said arm second end comprises an arm arch progressing toward said slot panel as said second end progresses away from said fulcrum pin.

15. The apparatus of claim 13, additionally comprising an arm biasing spring extending between said latch housing and said pivot arm, biasing said arm second end toward said slot panel, such that said mount contact and said arm contact are separated from each other.

16. The apparatus of claim 11, wherein said latch box slot panel comprises at least one hole for releasing sound waves generated by said sound generator.

17. The apparatus of claim 11, wherein said housing contains:

a battery mount connected to said housing having a spring clip and battery terminal fittings and containing a battery, a sound generator mounted to said housing, alarm circuit wiring extending from at least one said battery terminal fitting to said sound generator, a leaf spring having a spring first end and a spring second end, said spring first end being mounted within said latch box such that said spring second end extends in cantilever fashion in spaced relationship to and along said slide slot and in spaced relationship to one said battery terminal fitting, said leaf spring being electrically conductive and electrically connected to said alarm circuit wiring, such that upon insertion of said slide into said slide slot receiving opening, said slide abuts said leaf spring, and movement of said slide along said slide slot causes said slide to ride along said leaf spring toward said spring second end, causing said leaf spring second end to pivot toward said fastening panel until said leaf spring second end and said battery terminal fitting meet and close said alarm circuit, thereby activating said sound generator.

18. The apparatus of claim 11, wherein said link member is a chain.

19. An alarm and latch apparatus for a closure panel mounted within an opening perimeter of a building opening, comprising:

a closure panel link member having a link member first end mounted to said closure panel and a link member second end including a slot engaging slide, and a latch box having a slide slot with a slot end opening for receiving a portion of said slide, said latch box being mounted to said opening perimeter and containing an alarm circuit including means for alarm activation upon movement of said slide along said slide slot, wherein said link member is a solid stem connected to a line and pulley.

* * * * *